US007025180B2

(12) United States Patent
Wyss et al.

(10) Patent No.: US 7,025,180 B2
(45) Date of Patent: Apr. 11, 2006

(54) METHOD OF AND DEVICE FOR CONTROLLING AN ELEVATOR INSTALLATION WITH ZONAL CONTROL

(75) Inventors: Philipp Wyss, Buchrain (CH); Miroslav Kostka, Ballwil (CH)

(73) Assignee: Inventio AG, Hergiswil (CH)

( * ) Notice: Subject to any disclaimer, the term of this patent is extended or adjusted under 35 U.S.C. 154(b) by 332 days.

(21) Appl. No.: 10/700,392

(22) Filed: Nov. 4, 2003

(65) Prior Publication Data

US 2004/0144599 A1 Jul. 29, 2004

(30) Foreign Application Priority Data

Nov. 6, 2002 (EP) ..... 02405953

(51) Int. Cl.
*B66B 1/20* (2006.01)

(52) U.S. Cl. ..... 187/383; 187/388; 187/247; 187/385

(58) Field of Classification Search ..... 187/247, 187/248, 380–388; 701/56, 58
See application file for complete search history.

(56) References Cited

U.S. PATENT DOCUMENTS 3,851,735 A * 12/1974 Winkler et al. ..... 187/380
3,895,692 A * 7/1975 Yeasting ..... 187/382
4,147,235 A * 4/1979 Henry et al. ..... 187/387
4,511,017 A * 4/1985 MacDonald ..... 187/383
5,022,497 A * 6/1991 Thanagavelu ..... 187/382
5,503,249 A * 4/1996 Virtamo et al. ..... 187/382
5,511,634 A 4/1996 Bahjat et al.
5,637,841 A * 6/1997 Dugan et al. ..... 387/294
6,401,874 B1 * 6/2002 Siikonen ..... 187/382
6,808,049 B1 * 10/2004 Brand et al. ..... 187/383
2001/0002636 A1 * 6/2001 Siikonen ..... 187/382
2002/0129994 A1 9/2002 Kostka et al.
2005/0087402 A1 * 4/2005 Haegi et al. ..... 187/383

FOREIGN PATENT DOCUMENTS

JP 03177276 A * 8/1991

* cited by examiner

*Primary Examiner*—Jonathan Salata
(74) *Attorney, Agent, or Firm*—Butzel Long

(57) ABSTRACT

A method of controlling an elevator installation having a plurality of cars in a building with floors subdivided into several zones wherein travel orders are allocated to the cars. There is no allocation to an elevator car, which has just been allocated a travel order out of or into one of the zones, of any travel order out of or into another of the zones. In the case of a call after a new travel order the number of free elevator cars is compared with the number of still unallocated or still unserved zones and the allocation of the new call and is carried out in dependence on the comparison result.

11 Claims, 8 Drawing Sheets

METHOD OF AND DEVICE FOR CONTROLLING AN ELEVATOR INSTALLATION WITH ZONAL CONTROL

BACKGROUND OF THE INVENTION

The present invention relates to a method of and a device for controlling a elevator installation with several elevator cars in a building or the like, the floors of which are subdivided into several zones, wherein several travel orders are allocated to the elevator cars.

An elevator installation for zonal operation is shown in patent document EP 0 624 540. In the case of this elevator installation the traffic of persons between at least one main stopping point and zones in the high building is managed, with immediate allocation of zone calls, by an elevator installation consisting of three elevators. Each elevator user filling the building passes a portal which is associated with a zone in which a sensor registers the elevator user. Through selection of the corresponding portal the elevator user communicates his or her desired zone without manual actuation of a call registration device of the elevator control. The elevator cars travel in specific, fixedly associated zones. The zonal division serves the purpose of being able to fill a high building particularly quickly. For that purpose there are express elevators which travel past floors not served by these elevators.

On the same basis a zonal division is carried out also in the case of the elevator installation which is shown in the U.S. Pat. No. 5,511,634. In that case, of the respectively free elevator cars there is allocated a new call to a new zone to that car which can serve this call most quickly.

An object of the present invention is to construct a method of and a device for controlling an elevator installation in such a manner that a zonal control can be carried out with separation of user groups associated with the zones whereby waiting times for individual user groups are minimized as much as possible.

SUMMARY OF THE INVENTION

In the case of the control method according to the present invention the zones are preferably to be assigned to individual user groups with restricted access authorization. By contrast to the previously described elevator installations and the controls thereof, in the case of the method according to the present invention a zonal operation serves for security purposes in order to strictly separate user groups from one another. If an elevator with a travel order assigned to a zone is busy, then further travel orders may be allocated thereto only from the same zone. The elevator car can be allocated to another zone only when it has finished all travel orders allocated thereto and thus is free. Before a call in accordance with a new travel order is allocated, in accordance with the present invention, however, firstly the number of free elevator cars is compared with the number of still unallocated, i.e. currently unserved, zones. It is thereby established whether still sufficient free elevator cars are present for all zones. This is then taken into consideration in the decision as to where to allocate the new call.

In a preferred embodiment of the present invention a call which is assigned to a zone already served by the elevator installation is allocated to a free elevator car only when a free elevator remains for each unserved zone. The calls are thereby so distributed to the individual zones of associated user groups that at least one elevator is always available for each group.

A particularly preferred form of embodiment solves problems which arise in the case of a physical separation of user groups on the basis of the access authorization thereof for a different elevator layout. Thus, there can be elevator installations in which some floors can be served only by a subgroup of elevators. If now specific user groups are assigned or to be assigned to these floors able to be served only in a restricted manner, substantially increased waiting times can in part occur with these or with the other user groups depending on travel destination, or the persons of other user groups can no longer be allocated.

According to the preferred embodiment this can be solved in that in the case of a new call it is established whether it is assigned to a zone which comprises at least one floor able to be served only in restricted manner. Such zones are here termed "favorite zones". Calls assigned to such a favorite zone are here termed "favorite calls". For the decision how a call is allocated it is preferably to be initially established whether it is a favorite call or not a favorite call, i.e. a non-favorite call. The allocation is then carried out in dependence on this determination.

In a further preferred embodiment such favorite calls are preferentially assigned to elevator cars which can serve all floors of a favorite zone. Such an elevator car is here termed "favorite car". In the case of allocation of a call it is preferably initially established whether or not the call is a favorite call, wherein for the allocation of favorite calls the number of free favorite cars is compared with the number of still unallocated favorite zones in order as far as possible to always be able to keep free one favorite car per unallocated favorite zone. In the case of a non-favorite call the number of non-favorite cars is compared with the still unallocated non-favorite zones in order as far as possible to always to be able to keep free one free non-favorite car per unallocated non-favorite zone.

In this manner, notwithstanding a heterogeneous elevator structure the individual user groups are handled uniformly and the waiting times for each specific user group are minimized. However, in the case of a correspondingly larger number of elevator cars to be allocated it is possible to react to an increased incidence of passengers in a user group.

It is thus also possible that several elevator cars are assigned to one zone. Then, also all elevator cars can be busy. If, however, an elevator car fails for whatever reason, then one of the user groups could thereby be disadvantaged if now an elevator was no longer available for its assigned zone.

For such a case it is provided in a preferred embodiment that when there are less free elevator cars than unserved zones, but one zone is served by several elevators, one of the elevator cars of these elevators serving these several zones is blocked for further orders. This car is then free after processing its orders and can be allocated to the unserved zone.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIGS. 11*a* through 11*c* are schematic illustrations of call allocations and new calls in the case of the elevator installation shown in FIG. 2, wherein FIG. 11*a* shows a start situation by way of example, FIG. 11*b* a new call in the case of the situation shown in FIG. 11*a* and FIG. 11*c* a call allocation, which would be obtained by a conventional control;

DESCRIPTION OF THE PREFERRED EMBODIMENT

General Observations 1.1 Introduction to the Problem of Zonal Control

A zonal control in buildings or the like (ships would also be conceivable) is used in order to separate different groups of elevator passengers from one another. The zonal control is a safety feature which is used in buildings or the like where passenger groups have to be separated from one another.

If there are, for example, two groups of passengers, namely a group "1" and a group "2", then in a zonally controlled building a passenger belonging to group "1" may not travel together with a passenger belonging to group "2".

In a zonally controlled building or the like every destination call is assigned to a zone. In order to separate passenger groups, an elevator which is busy may not accept any call assigned to a zone different from the zone which the elevator is just serving. It may be assumed, for example, that an elevator "A" serves a call for a zone "1". It may be further assumed that at this instant a passenger belonging to the group "2" registers a call. Due to the zonal separation the passenger from the group "2" may travel only in his or her zone "2", whilst the passenger from the group "1" may travel only in his or her zone "1". Accordingly this new call from the passenger belonging to group "2" cannot be assigned to the elevator "A".

In the case of the elevator installation present here as well as in the case of the control method fundamental here to such an elevator installation it shall be made possible to undertake a favorable control method with use of such a zonal control. The individual user groups respectively assigned to a zone shall be effectively separated from one another so that no person from a first user group can travel by an elevator serving a second zone.

The individual user groups can be assigned to the individual zones by known person identification measures. For this purpose the elevator installation can have different person identification devices. Examples are key switches, code buttons, electronic keys, chip cards, finger sensors, etc. Virtually any technology known in the sector of locking technology, such as, for example, in the case of doors, gates or motor vehicles, is usable. For example, a person belonging to a specific user group can register a call for a travel order with a destination floor in his or her zone only with use of a personal mechanical or electronic key or with input of his or her personal code. In the case of the corresponding control method there is thus preferably carried out, with the call input, a person identification in order to assign the call to a specific zone.

1.2 Change of Zones

In a zonally controlled building either each elevator can serve actual calls or it has no orders. If the elevator does not have any travel orders, it is "free". In free state an elevator can accept a call from any zone.

Figure 1:
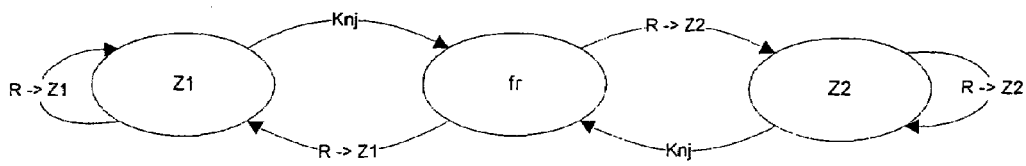
FIG. 1 is a diagram for clarification of a zonal control for elevator installations.

If an elevator serves calls within one zone, the elevator cannot change the zone until it is free. An example with two zones is indicated in FIG. 1. In that case the meanings are:

R→Z1—a call assigned to the zone "1"

Z1—zone "1"

Knj—the elevator has no orders fr—the elevator is free

R→Z2—a call is assigned to the zone "2"

Z2—zone "2"

FIG. 1 illustrates the above case.

2. Favorite Car Algorithms

In order to solve assignment problems in buildings with heterogeneous elevator layouts or heterogeneous elevator structures, so-called favorite car algorithms are used.

For illustration of the problem and the solution presented here, an elevator structure, by way of example, and some zones associated therewith are described in the following in the way that they can actually occur in specific buildings. All examples submitted with regard thereto are based on the zones and structures which have been presented. After an introduction the algorithm proposed in accordance with the example of embodiment is explained together with some examples.

2.1 Elevator Structure

Figure 2:
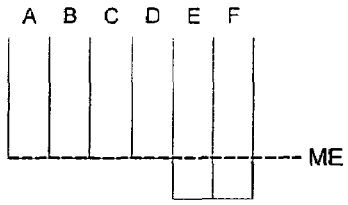
FIG. 2 is a schematic illustration of an elevator installation with several elevators and a heterogeneous elevator layout.

An example of a heterogeneous elevator structure (elevator layout) is reproduced in FIG. 2. The elevator installation schematically illustrated there comprises six elevators with elevator cars A, B, C, D, E and F. A main entrance ME is indicated by a dashed line. The elevators with the cars A, B, C and D go from the main entrance ME only upwards. In the example presented here the elevators with the cars E and F also serve basement floors lying below the main entrance ME. Thus, only the elevator cars E and F serve all floors of the building. The following examples refer to this elevator structure by way of example, as is presented in FIG. 2.

2.2 Zones

Figure 3:
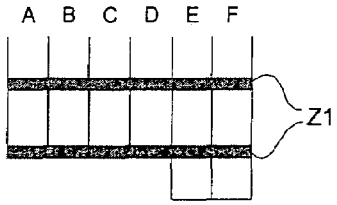
FIG. 3 is a schematic illustration of a first zone of the elevator installation shown in FIG. 2.
Figure 4:
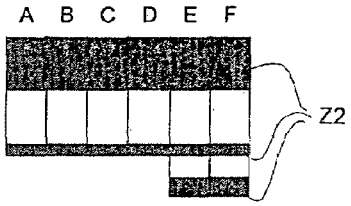
FIG. 4 is a schematic illustration of a second zone of the elevator installation shown in FIG. 2.
Figure 5:
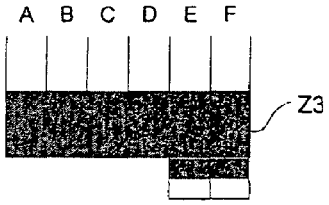
FIG. 5 is a schematic illustration of a third zone of the elevator installation shown in FIG. 2.

The building illustrated here is a building in which a zonal control is desired as a safety feature. For this purpose it may be assumed that the building is a bank building which additionally has public areas—for example a floor in which eating facilities are provided—and living areas. In FIGS. 3 through 5 the zones resulting therefrom and respectively to which individual user groups of the elevator installation are assigned are indicated in each instance by a shaded bar.

2.2.1 Zone 1: Visitors

In the example present here the first user group shall concern visitors. The visitors shall, in the example illustrated here, have access to the main entrance and to a visitor floor. The visitor floor can be, for example, the floor with publicly accessible eating facilities or the visitor rooms of the bank. Zone "1" is illustrated by the reference numeral Z1 in FIG. 3. There, a shaded bar is at the main entrance ME and a shaded bar at in the visitor floor.

The two further user groups for the example building are residents and bank staff.

The visitors have the following floors in common with the residents: main entrance ME and the visitor floor. The visitors have only the main entrance floor ME in common with the bank employees.

As apparent from FIG. 3, in the example illustrated here all elevators A through F serve the floors of the visitors and thus the zone Z1.

2.2.2 Zone 2: Residents

Residents of a building shall obviously have access to those floors on which their dwellings are located. Usually in the sub-floor of a building there are also regions which shall be accessible to a resident, such as basement areas or a residents underground garage.

In FIG. 4 a zone "2" by way of example—denoted by reference numeral Z2—is indicated for a resident. The floors for residents are, in the illustrated example, the main entrance ME, all floors from the visitor floor and thereabove and some floors below the main entrance.

The residents have the main entrance floor ME and the visitor floor in common with the visitors. The residents have only the floor "main entrance" ME in common with the bank employees.

2.2.3 Zone 3: Bank Staff

In the example illustrated in FIG. 5 the floors for the bank employees are all floors from the main entrance ME up to the visitor floor (wherein the visitor floor is not included therewith) and some floors below the main entrance ME. The zone "3" resulting therefrom is characterized in FIG. 5 by Z3. The bank employees accordingly have only the floor "main entrance" ME in common with the visitors and the residents.

2.3 Definitions

Some expressions are explained for better understanding of the favorite car algorithms:

2.3.1 Favorite Zone

A zone is a "favorite zone" if it contains floors which are not reachable by every elevator car. In the above examples the zones "residents" Z2 and "bank staff" Z3 are favorite zones.

2.3.2 Favorite Car (Favorite Elevator)

An elevator car is a "favorite car" if it can serve all floors of at least one favorite zone. In the above examples the elevator cars E and F are favorite cars.

2.3.3 Favorite Call

A call assigned to a travel order is a favorite call if it is assigned to a favorite zone. This can be established, for example, by known person identification measures as explained above. If a passenger is identified as a resident by a corresponding key or code, then he or she can register a travel order to a destination floor within the zone Z2. The corresponding call is then assigned to the zone Z2. In the case of the example illustrated here the visitor does not necessarily have to have a person identification. The bank employees in turn need a key or the like for input of a call assigned to the zone Z3.

2.3.4 Number of Unassigned Favorite Zones

Figure 6:
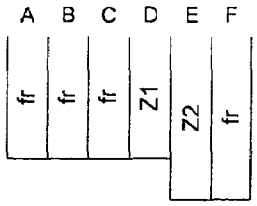
FIG. 6 is schematic illustration of an example of a call allocation to the elevator installation shown in FIG. 1.

The number of those favorite zones, which are not assigned at the time or in fact to any elevator or an elevator car, is termed number of non-assigned favorite cars. An example of that is reproduced in FIG. 6.

In that case the elevator cars A, B, C and F are free (this state is indicated in the drawings by the reference symbol fr). The elevators D and E are busy with travel orders. The elevator D serves a travel order of a visitor and thus is assigned to the zone Z1. The elevator E serves a travel order of a resident and is thus assigned to the zone Z2.

In this example the number of non-assigned favorite zones is one. The zone Z3 is a favorite zone, but it is not assigned to any elevator car.

2.3.5 Number of Non-assigned Non-favorite Zones

All zones which are not favorite zones are here termed non-favorite zones. The number of non-favorite zones which is actually or at the time not assigned to any elevator is termed the number of non-assigned non-favorite zones. In the example of FIG. 4 the number of non-assigned non-favorite zones is zero. The sole non-favorite zone in our example is the zone Z1. One elevator car, namely the elevator car D, is assigned to the zone Z1.

2.3.6 Sufficient Favorite Cars Available

The condition "sufficient favorite cars available" is to be fulfilled when the number of free favorite cars is greater than or equal to the number of non-assigned favorite zones.

This condition or this expression is advantageous when a decision has to be taken whether or not a call is to be assigned to a free elevator car.

Figure 7:
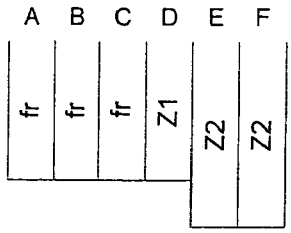
FIG. 7 is a schematic illustration of an example of a call allocation as would be achieved by conventional controls proceeding from the situation shown in FIG. 6.

In the example of FIG. 7 the elevator cars A through C are free. The elevator car D is assigned to the zone Z1 and the elevator cars E and F are assigned to the zone Z2. In this example insufficient elevator cars are available! The two favorite cars E and F are busy. A favorite car is no longer left for the favorite zone Z3.

2.3.7 Sufficient Non-favorite Cars Available

The condition "sufficient non-favorite cars available" is fulfilled when the number of free non-favorite cars is greater than or equal to the number of non-assigned non-favorite zones.

This expression is advantageous when a decision has to be taken whether or not a new call shall be placed in a free elevator car.

2.4 Why an Algorithm?

If a call is input by a user, the call is immediately assigned to a zone. According to known assignment algorithms—see for this purpose, for example, EP 0 301 178—the elevator control then selects the best elevator car which can serve this call. This can be undertaken, for example, in dependence on a costs minimization or on algorithms for the quickest possible filling and/or for shortening of waiting times. For the selection of the best elevator car there are at that instant only a few restrictions: the elevator car must be able to serve not only the starting floor, but also the destination floor, the zone state of the elevator car must be "free" fr or the zone assigned at that time to the elevator car must correspond with the zone assigned to the call.

Figure 8A:
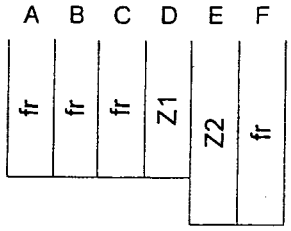
FIGS. 8*a* through 8*e* are schematic illustrations of different call allocations and new calls, starting out from the situation illustrated in FIG. 6.
Figure 8B:
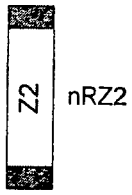
Figure 8C:
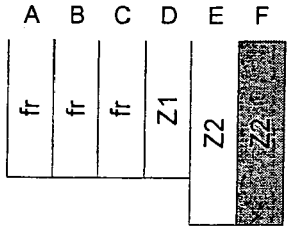
Figure 8D:
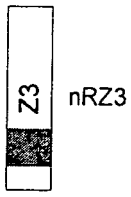

What can take place in that case is illustrated in FIGS. 8*a* through 8*c*.

In FIG. 8*a* there is illustrated, by way of example, the starting state. This state corresponds with the state of FIG. 6, i.e. the elevator car D is assigned to the zone Z1 and the elevator car E to the zone Z2, whilst the remaining elevator cars are free fr. In this state there is a new call nRZ2 in zone Z2, as illustrated in FIG. 8*b*. This new call nRZ2 is the requirement of a travel order between a residential floor and a basement floor accessible for residents.

The elevator control selects, for example, the elevator car F as the best elevator car.

The then-resulting allocation situation is reproduced in FIG. 8*c*. The state corresponds with that of FIG. 7, wherein the newly allocated call is shaded.

Without a special algorithm the following situation can now arise:

It may be assumed that a new call nRZ3 is now indicated by a bank employee, who would like to go between the main entrance ME and the basement floor accessible only for bank staff. This new call belongs to the zone Z3 and contains one of the basement floors.

Figure 8E:
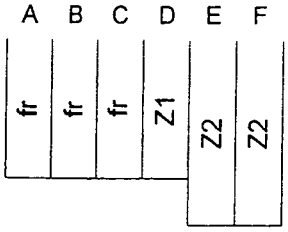

As FIG. 8*e* shows, there is no available elevator car for this purpose. The free elevator cars A to C cannot serve the basement floor and the two favorite cars E and F, which could serve the basement floor, are assigned to another zone Z2 and therefore may not be assigned to the zone Z3.

The bank employee therefore has to wait until one of the two elevator cars E and F is free again. Since also new destination calls from the zone Z2 could always be input again here, this wait can in certain circumstances last for a very long time.

For a solution of such a problem an "allocation to a free car" algorithm is proposed. This analyses the situation and shifts the elevator allocation of the call belonging to the zone Z2 to the elevator car E and not to the elevator car F.

After the algorithm has been performed, the call can be definitively assigned and information can be given to the user to indicate to him or her the allocated car for his call.

2.5 The "Assignment to a Free Car" Algorithm

Figure 9:
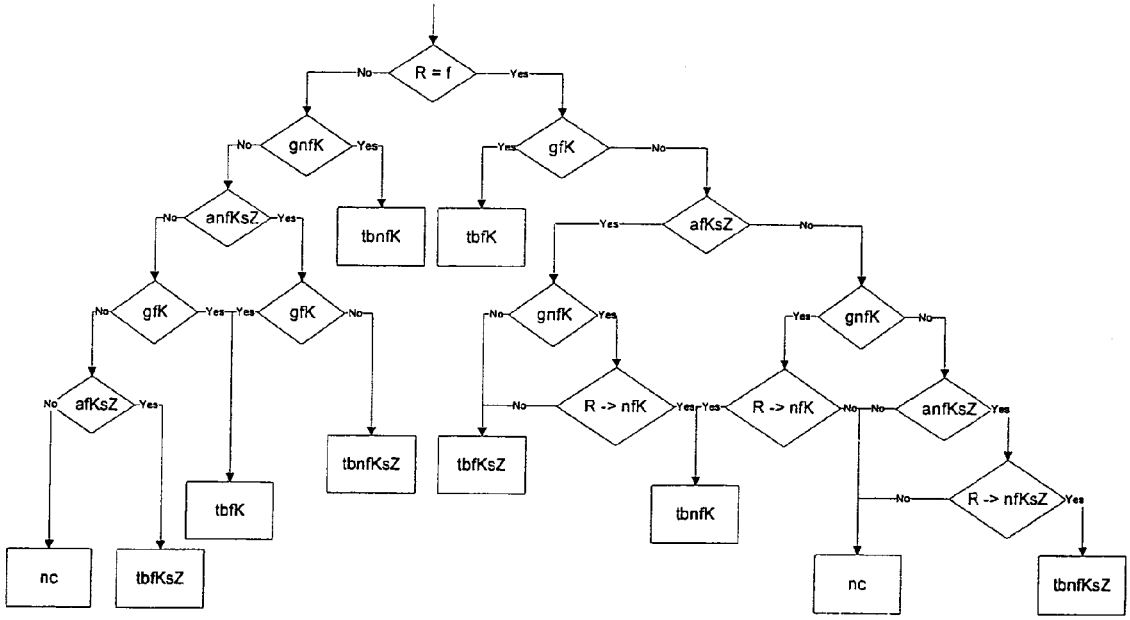
FIG. 9 is a flow chart for an algorithm in the control of an elevator installation, such as is illustrated by way of example in FIGS. 2 to 5.

The "assignment to a free car" algorithm is reproduced in FIG. 9 in the form of a flow chart. The flow chart is, with consideration of the following legends, self-explanatory:

R=f—Call is a favorite call. Here it is investigated whether or not the call is a favorite call.

GfK— Sufficient favorite cars available? This condition is investigated on the basis of the above definition. In that case the interrogation is (also) carried out in such a manner that it is investigated whether after an allocation of the new call to a free favorite car sufficient favorite cars are then still available.

TbfK—Take the best favorite car. The selection from the number of free favorite cars is carried out according to the criteria also used with customary control algorithms.

AfKsZ—Other favorite cars travel in the same zone. Here it is investigated whether there is already a favorite car which is assigned to the same zone to which the new call belongs.

GnFK—Sufficient non-favorite cars available? With the interrogation it is preferably also investigated whether after allocation of the new call to a free non-favorite car sufficient non-favorite cars are then still available.

R→nfK—Call can be shifted to a non-favorite car.

AnfKsZ—Other non-favorite cars travel in the same zone.

TbfKsZ—Take the best favorite car travelling in this zone.

TbnkF—Take the best non-favorite car.

R→nfKsZ—Call can be shifted to a non-favorite car travelling in this zone.

TbnfKsZ—Take the best non-favorite car travelling in this zone.

nc—No change.

2.5.1 What Would the Algorithm do in the Example of FIGS. 8*a* through 8*e?*

Figure 10:
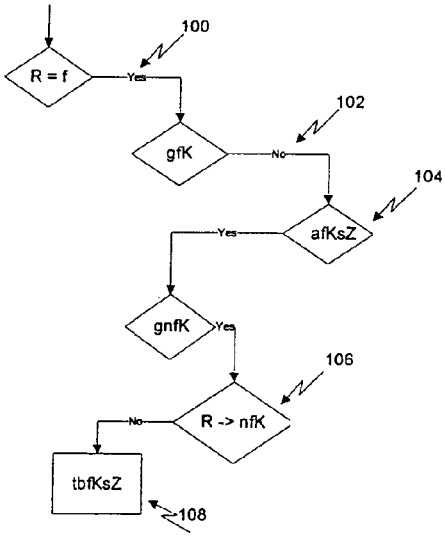
FIG. 10 is a part of the flow chart of FIG. 9 with reference numerals.

For this purpose reference is made to the decision branch, which is illustrated in FIG. 10, from the algorithm of FIG. 9. At 100 the condition "the call is a favorite call" has been found to be "true": The call illustrated in FIG. 8*b* belongs to the favorite zone Z2 and is thus a favorite call.

If the call—as happens in our example by the upstream customary control algorithm—were to be placed with the elevator car F, sufficient elevator cars for a call in the favorite zone Z3 would no longer be available. The condition "sufficient favorite cars available" gfK is thus not fulfilled, as is indicated by the reference numeral 102.

On the other hand, the favorite car E already travels in the zone Z2. The condition "other favorite cars travel in the same zone" afKsZ is thus fulfilled, as is recognizable by the reference numeral 104.

There are still three free non-favorite cars. The condition "sufficient non-favorite cars available" gnfk is thus fulfilled. However, the new call nRZ2 of FIG. 8*b* cannot be allocated to any non-favorite car, since none of the non-favorite cars A to D can serve the basement floor contained in the new call nRZ2, which leads to the decision reproduced at 106.

Thus, the algorithm leads to the statement tbfKsZ, i.e. the best non-favorite car travelling in this zone must be taken, as indicated at the reference numeral 108. This is the correct decision, because now the new call nRZ2 is allocated to the elevator car E and thus a favorite car F is kept free for the favorite zone Z3. The new call nRZ3 of FIG. 8*d* can be allocated without undue waiting times.

2.5.2 A Further Example

Figure 11A:
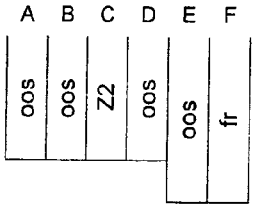
Figure 11B:
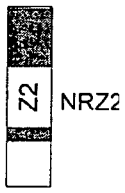

FIG. 11*a* represents a further situation which can happen. In the case of FIG. 11*a* the elevators of the cars A, B, D and E are out of operation, which is indicated by the reference symbol oos (out of service). The elevator car C is assigned to the zone Z2 and the elevator car F is free fr. It may now be assumed, as illustrated in FIG. 11*b*, that a new call NRZ2 is input in the zone Z2, which demands a travel order between the main entrance ME and an upper residential floor. Such an order, by way of example, can also not be dealt with by a non-favorite car A or B. Conventional elevator controls would assign such a new call NRZ2 to, for example, the elevator car F, since it recognizes this as best elevator car.

Figure 11C:
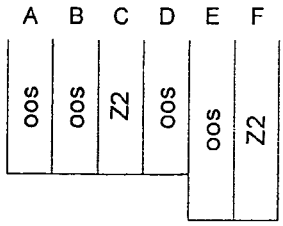

Without an algorithm there would thus be the situation illustrated in FIG. 11*c*, according to which the elevator cars C and F are both assigned to the zone Z2 and the remaining elevator cars are out of operation oos.

There is then the problem that a possible new call to be assigned to the zone Z3 (see, for example, the call nRZ3 from FIG. 8*d*) cannot be assigned particularly when this call can be served only by a favorite car.

Figure 12:
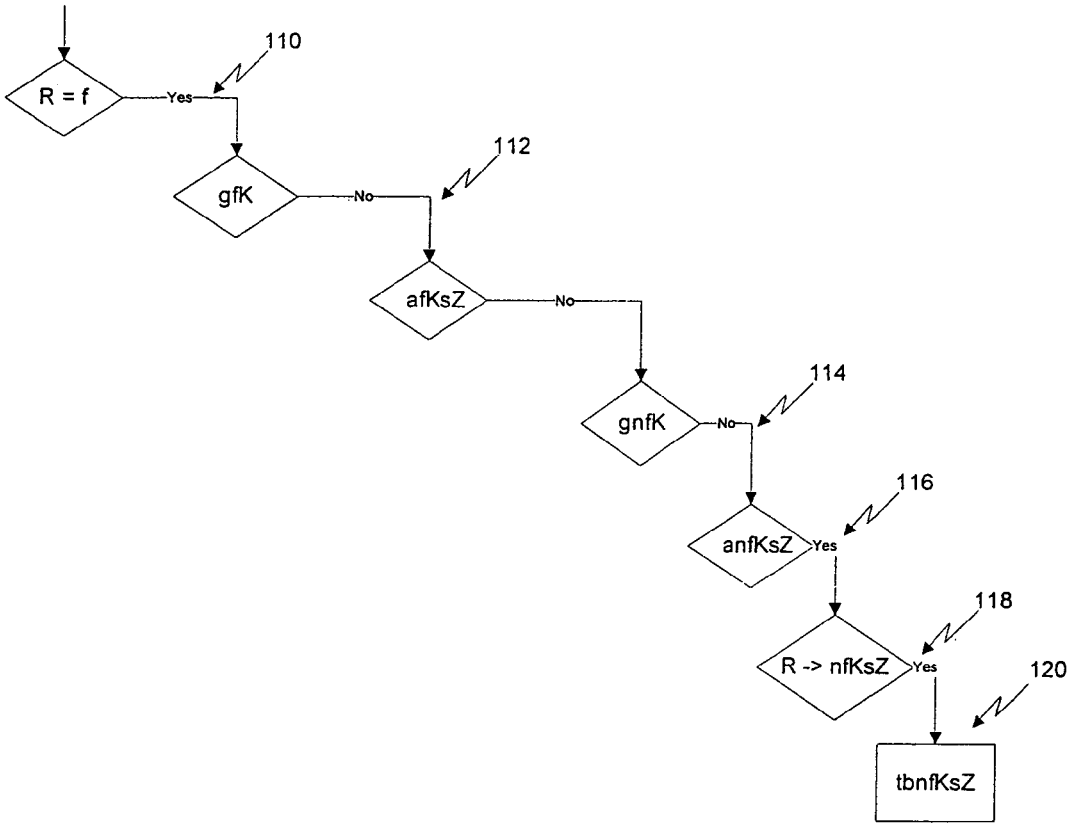
FIG. 12 is a part of the flow chart of FIG. 9 with reference numerals for illustration of how the control algorithm shown in FIG. 9 would perform the call allocation.

In FIG. 12 it is shown what the algorithm illustrated in FIG. 9 would do in this case.

As indicated at 110, the algorithm has decided that the call is assigned to the zone Z2 and is thus a favorite call. The decision 112 is based on the fact that only one favorite car is left, but there are two favorite zones. If the call were to be assigned to the elevator car F, sufficient favorite cars would then no longer be available. This leads to the decision 112.

At 114 it is to be noted that in the situation illustrated in FIG. 11*a* no car is left for the non-favorite zone Z1, since only a single non-favorite car C travels in the zone Z2 and all other non-favorite cars are unavailable. This leads to the decision that insufficient non-favorite cars are available.

The non-favorite car C travels in zone Z2. There are thus still other non-favorite cars travelling in the same zone, as is indicated at 116.

Since the new call NRZ2 concerns only the floor main entrance ME and floors lying thereabove, the call can be allocated to a non-favorite car travelling in the same zone. The non-favorite car C travelling in the same zone can serve all floors in upward direction from the entrance. The corresponding decision is shown at 118.

Thus the algorithm leads at 120 to the instruction ZbnfKsZ to take the best non-favorite car travelling in the same zone. This is, in the example of FIG. 11*a*, the car C!

Figure 13:
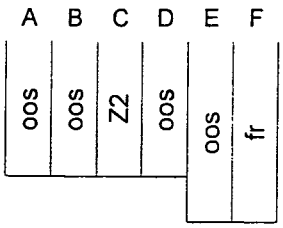
FIG. 13 is a schematic illustration of the final situation of the call allocation as is obtained by the algorithm shown in FIG. 9 starting out from the situation according to FIG. 11*a;*

The corresponding allocation undertaken on the basis of the algorithm is reproduced in FIG. 13. The algorithm shifts the call allocation of the call NRZ2 from the elevator car F selected by upstream elevator algorithms to the elevator car C. The algorithm has kept free the elevator car F for further calls belonging to the zone Z3. A call belonging to the zone Z3 can thus be served in every case.

Note: If, however, a new call cannot be moved to the zone Z2 or the elevator car C, the algorithm would lead to the decision "no change" nc. The call would not be shifted at all. Then, according to the otherwise known algorithms, the elevator car F would be allocated to the call.

2.5.3 EXAMPLE ONE (1)

Figure 14:
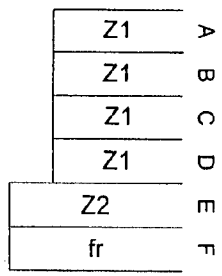
FIGS. 14 through 17 are further schematic illustrations of call allocation situations in the elevator installation according to FIG. 2 for clarification of the function of the control algorithm according to FIG. 9.

Reference will be made to FIG. 14. As apparent therefrom, there is again the elevator layout according to the foregoing examples (FIGS. 2 to 5) with six elevators A through F. There are two favorite cars of the elevator group, which are denoted by E and F. There are the following defined zones:

Zone Z1—non-favorite zone

Zone Z2—favorite zone for the cars E, F

Zone Z3—favorite zone for the cars E, F

The car E may be assigned to the zone Z2. The car F may be free. For a new call allocated to the zone Z1, a costs calculation algorithm would select, for example, car F for this call. If the car F were to be allocated to the zone Z1, however, no car would be left for the zone Z3.

The algorithm of FIG. 9 prevents this problem. As readily seen from the flow chart of FIG. 9, the algorithm decides in this example that the best non-favorite car, which already travels in this zone Z1, is to be taken for this new call for zone Z1.

2.5.4 EXAMPLE TWO (2)

Figure 15:
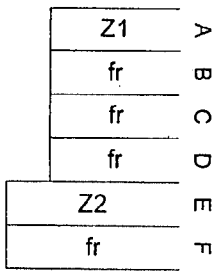

Here reference is made to FIG. 15. As evident therefrom, there is again the elevator layout according to the foregoing examples (FIGS. 2 to 5) with six elevators A through F. There are two elevator cars of the elevator group, which are denoted by E and F. There are the following defined zones:

Zone Z1—non-favorite zone

Zone Z2—favorite zone for the cars E, F

Zone Z3—favorite zone for the cars E, F

In this example it may be assumed that the car A is to be allocated to the zone Z1 and the car E to the zone Z2. The remaining cars may be free fr.

If now the car F were to be allocated to the zone Z1, no favorite car would be left for the zone Z3. In order to avoid this problem, the algorithm decides—as readily seen from the flow chart of FIG. 9—that the best non-favorite car must be taken for this new call.

2.5.5 EXAMPLE THREE (3)

Figure 16:
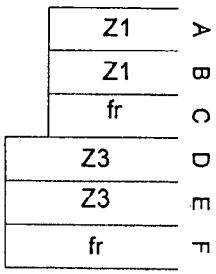

The third example is illustrated in FIG. 16. There is here again six elevators, but three non-favorite cars A to C and three favorite cars D through F. As defined zones there may be assumed:

Zone Z1—non-favorite zone

Zone Z2—non-favorite zone

Zone Z3—favorite zone for the cars D through F

Zone Z4—favorite zone for the cars D through F

In the case of the example according to FIG. 16 the cars A and B are assigned to the zone Z1 and the cars D and E to the zone Z3. The cars C and F may be free. There is now a new call assigned to the zone Z3. A pure costs calculation algorithm would assign this new call to, for example, the elevator car C.

If, however, the elevator car were to be assigned to the zone Z3, no elevator car would remain for the zone Z2.

The decision of the algorithm can—as also in the case of the above Examples One and Two—be readily obtained from the flow chart of FIG. 9. As evident therefrom, the algorithm avoids the above-mentioned problem. The algorithm decides that the best favorite car, which already travels in the zone Z3, must be taken for this new call assigned to the zone Z3. The algorithm may not take the car F, because then a car would no longer be left for zone Z4.

2.5.6 EXAMPLE FOUR (4)

Figure 17:
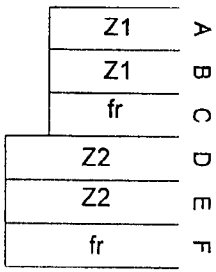

Reference is made to FIG. 17 for the Example Four. Here an elevator layout as in FIG. 16 may be assumed. Accordingly, there are three favorite cars in an elevator group, which are denoted by D, E and F. Two of them may be assigned to the zone Z2. Overall the following zones may be defined here:

Zone Z1—non-favorite zone

Zone Z2—favorite zone for the cars D through F

Zone Z3—favorite zone for the cars D through F

The elevator cars C and F may be free. For a new call assigned to the zone Z2 a costs calculation algorithm would select, for example, car F for this call.

If, however, the car F were to be assigned to the zone Z2, no favorite car would be left for zone Z3.

It is readily evident from the flow chart of FIG. 9 what the algorithm presented here does in this case. It attempts to place this call with the car C if this is possible, so as to keep a favorite car free for zone Z3. If this is not possible, the best favorite car, which travels in the zone Z2, must take the call.

2.6 The "Missing Car for Zone" Algorithm

Figure 18:
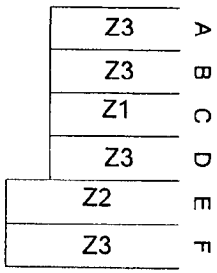
FIGS. 18 and 19 are, by way of example, schematic illustrations of a call allocation without a free elevator car, for the purpose of explanation of a problematic situation.

Reference may now be made to a situation as illustrated in FIG. 18. Here again an elevator structure, by way of example, as evident from FIG. 2 is assumed. The subdivision of the individual floors of the building provided therewith takes place as explained above with respect to FIGS. 3 to 5. In the case of the illustrated situation the cars A, B, D and F serve the zone Z3. The car C is assigned to the zone Z1 and the car E is assigned to the zone Z2. Only a single car travels in the zone Z1. All other cars travel in other zones. No car is free.

Figure 19:
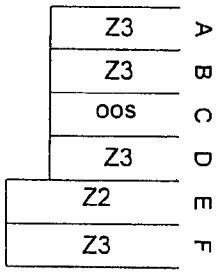

It may now be further seen, as illustrated in FIG. 19, that the elevator car travelling in the zone Z1 is unavailable. This is indicated by the reference symbol oos for "out of operation". In other words, the zone Z1 is "lost". From now on, all persons who want to register a call assigned to the zone Z1 can no longer be served.

Figure 20:
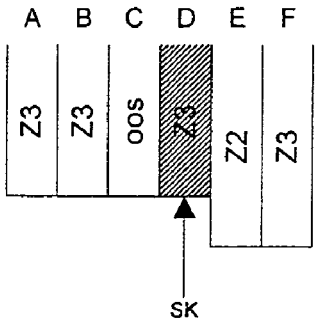
FIGS. 20 and 21 are schematic illustrations of call allocations corresponding to FIGS. 18 and 19 for the purpose of illustration of a solution to this problem.
Figure 21:
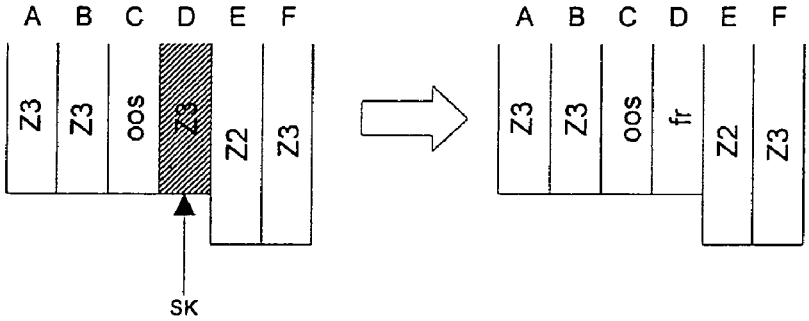

At this instant an algorithm, which is termed "missing car for zone", begins to work:

The mode of operation is illustrated in FIGS. 20 and 21. As is evident from FIG. 20, this algorithm determines from all travelling (i.e. non-free) cars a specific car which will no longer receive calls. This car—in the example, car D—is blocked against new calls. A car in such a state is here termed "jumper car" SK.

As illustrated in FIG. 21, a jumper car, as soon as it has processed all existing calls, is free and can then process calls for the zone that has become lost. In the final situation illustrated at the right in FIG. 21 the car D can now be used for the zone Z1. The "missing car for the zone" algorithm in this situation again stops working.

If more than one zone becomes "lost" in the above-described manner, this algorithm selects for each lost zone a jumper car which then jumps into the free state after processing its orders from the allocated zone.

Two lists are maintained by the "missing car for zone" algorithm: These are on the one hand a list for all favorite cars (favorite jumper cars) blocked against new orders and on the other hand a list for all non-favorite cars (non-favorite jumper cars) blocked against new orders.

Figure 22:
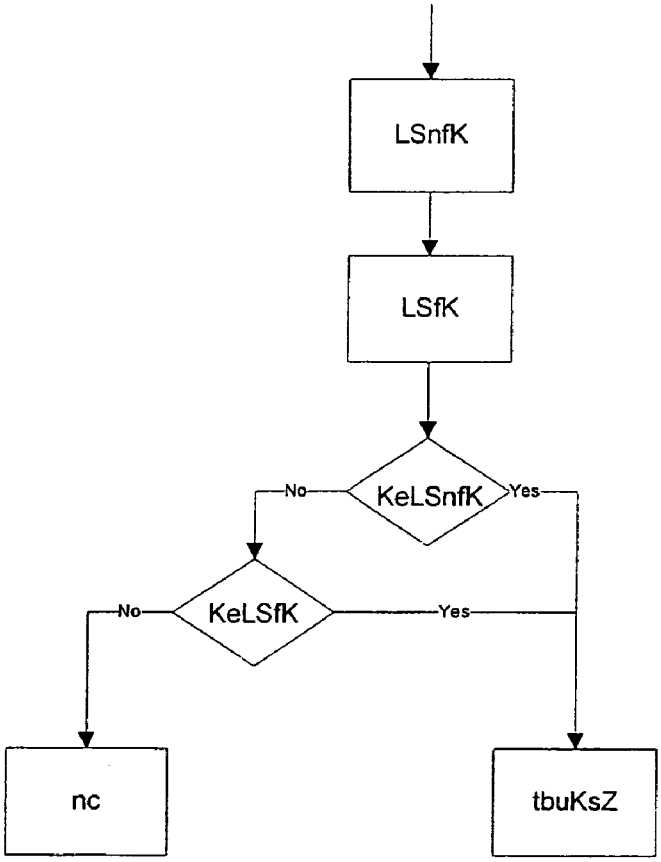
FIGS. 22 through 24 are flow charts of an algorithm for solution of the problem illustrated in FIGS. 18 and 19.
Figure 23:
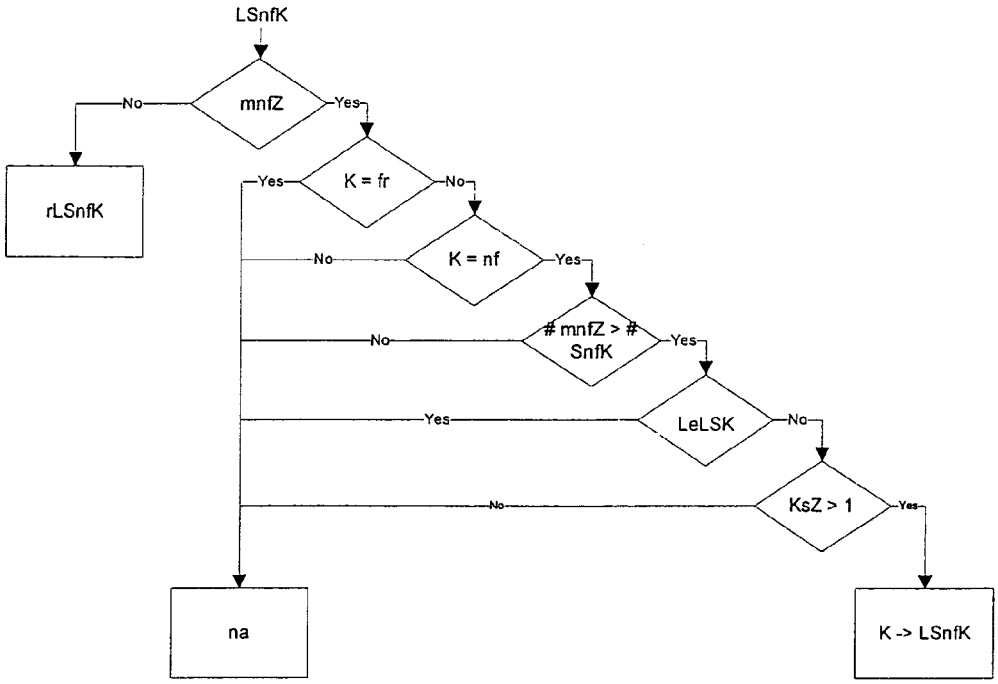
Figure 24:
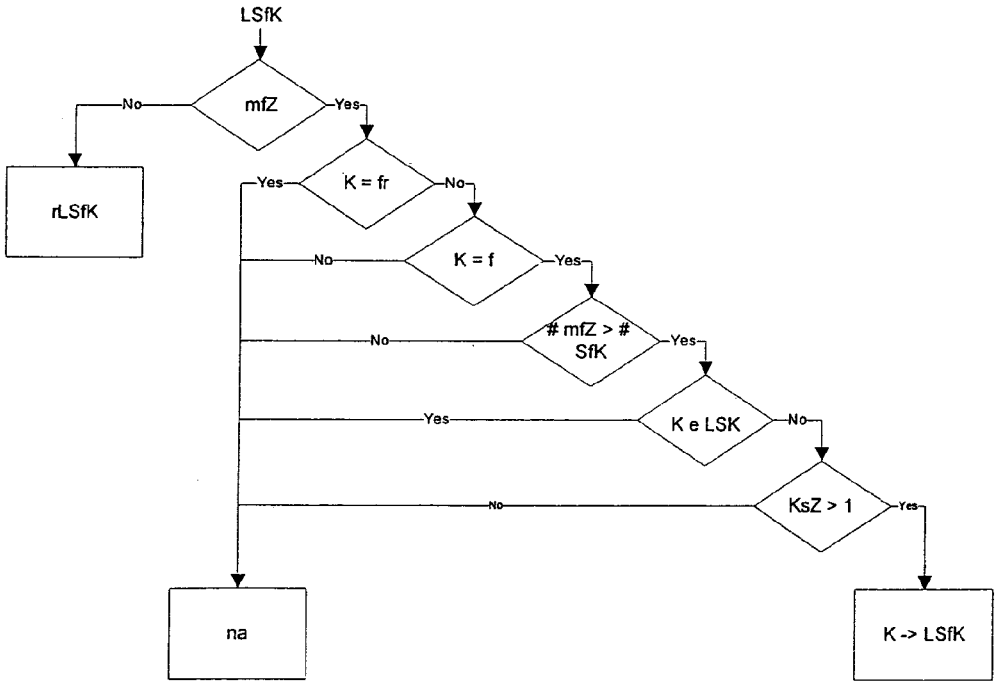

An example of a "missing car for zone" algorithm is illustrated in FIGS. 22, 23 and 24, wherein FIG. 22 illustrates the main part of the algorithm, FIG. 23 the process of maintaining of the list of non-favorite jumper cars and FIG. 24 the process of maintaining the list of favorite jumper cars.

The flow charts reproduced in FIGS. 22 to 24 are self-explanatory with consideration of the legends set out below.

The "missing car for zone" algorithm illustrated therein is called up each time before a call is definitively assigned to a car.

Legends for the flow charts of FIGS. 22 to 23:

LSnfK—Maintaining the list of non-favorite jumper cars;

LSFK—Maintaining the list of favorite jumper cars;

KeLSnfK—Car is in the list of non-favorite jumper cars;

KeLSfK—Car is in the list of favorite jumper cars;

nc—No change;

tbuKsZ—Take the best non-jumper car travelling in this zone (in other words, the algorithm blocks the jumper cars against a new call allocation);

mnfZ—Missing non-favorite zones;

rLSnfK—Reset the list of non-favorite jumper cars (the list of those non-favorite cars, which are blocked for new call allocations, is set to zero);

K=fr—Car is free;

K=nf—Car is non-favorite car;

#mnfz>#SnfK—The number of missing non-favorite zones is greater than the number of non-favorite jumper cars;

KsZ>1—More than one car travels in this zone;

K→LSnfK—Add car to the list of non-favorite jumper cars;

na—No action;

mfZ—Missing favorite zones;

rLSfK—Reset the list of favorite jumper cars (the list of those cars blocked for a new call allocation is set to zero);

K=f—Car is favorite car;

#mfz>#SfK—The number of missing favorite zones is greater than the number of favorite jumper cars; and K→LSfK—Add car to the list of favorite jumper cars.

2.6.1 EXAMPLE

Figure 25:
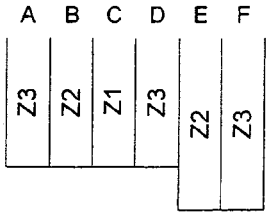
FIGS. 25 through 27 are schematic illustrations of different call situations, by way of example, for explanation of the function of the algorithm according to FIGS. 22 through 24.

Reference may be made to FIG. 25, which shows a starting situation by way of example. In that case the elevator structure and the zone division may again be assumed to be such as explained in FIGS. 2 to 5. There are accordingly the following defined zones:

Zone Z1—non-favorite zone

Zone Z2—favorite zone for the cars E, F

Zone Z3—favorite zone for the cars E, F

The allocation of the individual elevator cars A through F to these zones is apparent from FIG. 25.

Figure 26:
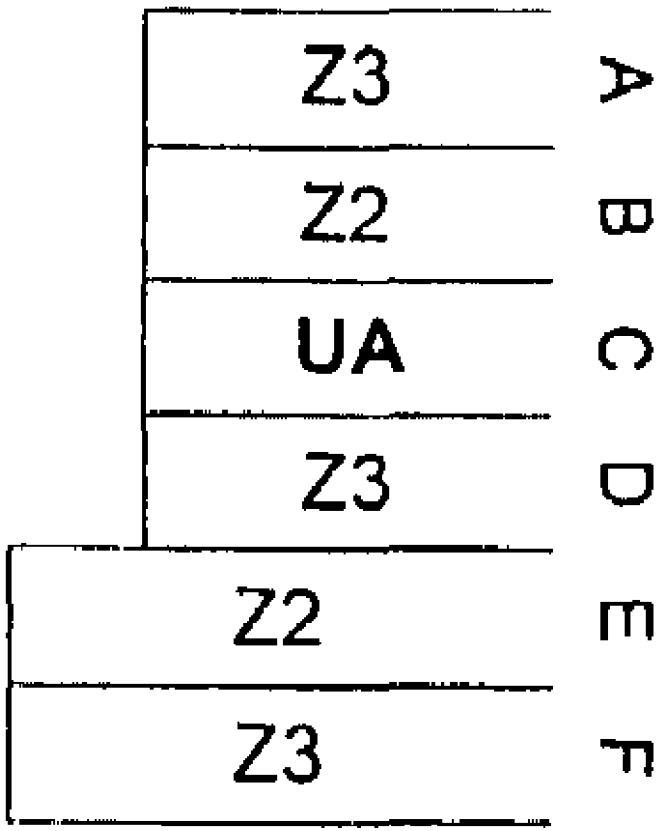
Figure 27:
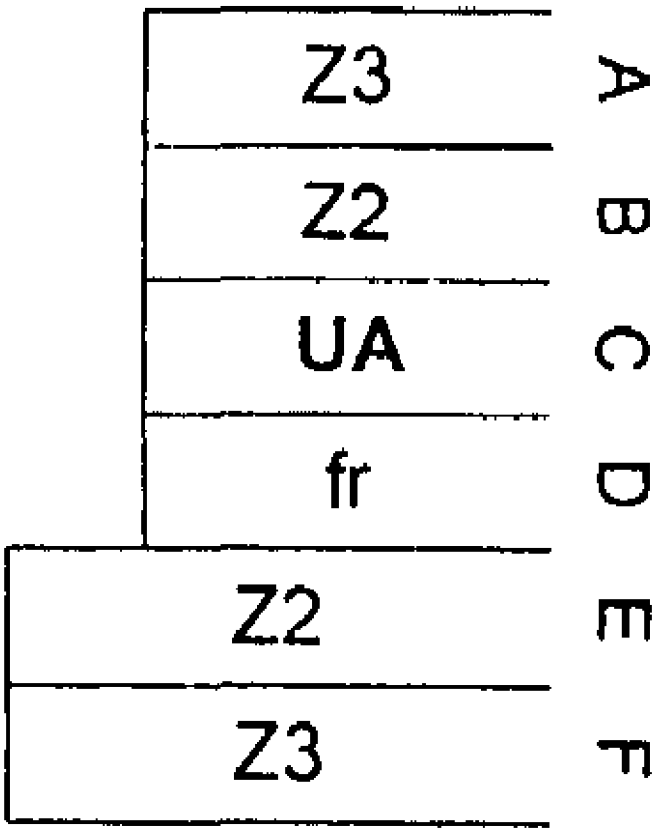

The car C is now suddenly unavailable, which is indicated in FIGS. 26 and 27 by "UA" (unavailable). In the case of the situation in FIG. 26 resulting therefrom future and waiting passengers, who are assigned to the zone Z1, can no longer be transported.

Now a new call is input. The call may be assigned to the zone Z3. A costs calculation algorithm would decide, for example, that the elevator car D is the best for this call.

It is readily apparent from the flow charts 22 to 24 what the "missing car for zone" algorithm would do in this case. This algorithm assigns the call not to the car D, but selects the car D as jumper car. The call is now assigned to the best of those other cars which already travel in zone Z3.

Later, as illustrated in FIG. 27, the car D is free fr. The car D is now free for an assignment to the zone Z1.

It is to be noted that the car D is now in fact kept free by the above-explained "assignment to free car" algorithm.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of controlling an elevator installation having a plurality of elevator cars each serving at least two floors in a building, the floors being subdivided into several zones, wherein travel orders each associated with one of the zones are allocated to the elevator cars, comprising the steps of:

a) during a time that one of the elevator cars executes a travel order for one of the zones, preventing a travel order for another zone from being allocated to the one elevator car;

b) in response to a call for a travel order, comparing the number of free elevator cars with the number of still unallocated or still unserved zones; and c) allocating the travel order forming the call to an elevator car in dependence on the comparison result.

2. The method according to claim 1 including performing said step c) for a new call that is assigned to a zone already served by at least one of the elevator cars by allocating the new call to a free elevator car only when the number of free elevator cars is greater than or equal to the number of zones then not being served by the elevator installation.

3. The method according to claim 2 wherein when the number of free elevator cars is smaller than the number of the zones not served by the elevator installation, allocating the new call to an elevator car which already travels in the same zone to which the new call is assigned.

4. The method according to claim 1 wherein at least one of the floors cannot be served by all elevator cars of the elevator installation and the zones include at least one favorite zone having at least one floor not able to be served by all of the elevator cars, and said step c) is performed by allocating the new call in dependence on whether or not it is assigned to the at least one favorite zone.

5. The method according to claim 4 wherein at least one of the elevator cars is a favorite car which can serve all floors of the at least one favorite zone, whereby when the new call is assigned to the at least one favorite zone, said step b) is performed by comparing the number of free favorite cars with the number of still unallocated favorite zones or favorite zones still not served by the elevator installation and said step c) is performed by allocating the new call in dependence on the comparison result, and when the new call is not assigned to the at least one favorite zone, said step b) is performed by comparing the number of free non-favorite cars with the number of still unallocated non-favorite zones or non-favorite zones still not served by the elevator installation and said step c) is performed by allocating the new call in dependence on the comparison result.

6. The method according to claim 5 wherein the new call assigned to the at least one favorite zone is allocated to a free favorite car only when the number of free favorite cars is greater than or equal to the number of favorite zones not then served by the elevator installation and the new call not assigned to the at least one favorite zone is allocated to a free non-favorite car only when the number of free non-favorite cars is greater than or equal to the number of the non-favorite zones not currently served by the elevator installation.

7. The method according to claim 1 including performing said step c) when the number of free elevator cars is smaller than the zones not currently served by the elevator installation and a zone is served by two or more elevator cars by blocking one of the two or more elevator cars against further allocations until the one elevator car is free and thus an allocation is accessible to one of the unserved zones.

8. The method according to claim 7 wherein when the elevator installation has a total number of zones smaller than or equal to the number of elevator cars, one of the elevator cars which serves the same zone as another one of the elevator cars is blocked per unserved zone against new allocations.

9. The method according to claim 1 wherein the subdivision of the floors into several zones is dependent on access authorization of passengers desiring to travel to the floors.

10. A control device for an elevator installation for performing the method according to claim 1 comprising: software adapted to run on a computerized elevator control and performing said steps a) through c).

11. A method of controlling an elevator installation having a plurality of elevator cars each serving at least two floors in a building comprising the steps of:

a) subdividing the floors into several zones based upon access authorization of passengers;

b) allocating travel orders each associated with one of the zones;

c) during a time that one of the elevator cars executes a travel order for the one of the zones, preventing a travel order for another zone from being allocated to the one elevator car;

d) in response to a call for a travel order, comparing the number of free elevator cars with the number of still unallocated or still unserved zones; and e) allocating the travel order associated with the call to an elevator car in dependence on the comparison result.

* * * * *